US006031228A

United States Patent [19]

Abramson

[11] Patent Number: 6,031,228

[45] Date of Patent: Feb. 29, 2000

[54] DEVICE FOR CONTINUOUS ISOTOPE RATIO MONITORING FOLLOWING FLUORINE BASED CHEMICAL REACTIONS

[76] Inventor: Fred P. Abramson, 2123 O St., NW., Washington, D.C. 20037

[21] Appl. No.: 09/038,017

[22] Filed: Mar. 11, 1998

Related U.S. Application Data

[60] Provisional application No. 60/040,716, Mar. 14, 1997.

[51] Int. Cl.[7] ..... H01J 49/04

[52] U.S. Cl. ..... 250/288; 250/281; 436/173; 436/161; 422/70

[58] Field of Search ..... 250/288, 281; 436/173; 422/70

[56] References Cited

U.S. PATENT DOCUMENTS 4,933,548 6/1990 Boyer et al. ..... 250/288

OTHER PUBLICATIONS

H. Song and F. Abramson, "Nitrogen Trifluoride: A New Reactant Gas in CRIMS for Detection of Phosphorus, Deuterium, Chlorine, and Sulfur", American Society for Mass Spectrometry, 1995, No. 6, pp. 421–427.

*Primary Examiner*—Edward P. Westin
*Assistant Examiner*—Nikita Wells
*Attorney, Agent, or Firm*—Antonelli, Terry, Stout & Kraus, LLP

[57] ABSTRACT

An apparatus and method for measuring the isotope ratio of samples containing carbon and nitrogen compounds. The method includes steps of (a) adding a sample containing carbon or nitrogen compounds to a sample introduction component in which a mixture of analytes is separated into specific molecules, and wherein said sample introduction comprises means for continuous sample introduction into a chemical reaction interface (CRI); wherein said CRI converts intact carbon and nitrogen analytes into new element-specific compounds in an environment comprising fluorine to resolve said compounds; and (b) calculating the isotope ratio of the compounds of said sample with mass spectrometer capable of making precise isotopic measurements. The reactant gas in the reaction chamber is a fluorine gas which allows for better resolution and calculation of the isotope ratio of carbon and nitrogen compounds, with hydrogen, sulfur and oxygen-containing compounds.

16 Claims, 4 Drawing Sheets

DEVICE FOR CONTINUOUS ISOTOPE RATIO MONITORING FOLLOWING FLUORINE BASED CHEMICAL REACTIONS

CROSS-REFERENCE TO RELATED APPLICATION

This application is a continuation-in-part of provisional application Ser. No. 60/040,716, filed on Mar. 14, 1997.

TECHNICAL FIELD

The present invention related to apparatus and method for measuring the isotope ratio of samples containing carbon and nitrogen compounds along with compounds containing hydrogen, oxygen, and sulfur isotopes.

BACKGROUND ART

Mass spectrometry apparatus are known in the art. For example, U.S. Pat. No. 5,468,452 discloses a quantitative analysis combining high performance liquid chromatograph and mass spectrometry.

In accordance with the patent, quantitative analysis of organic compounds is carried out using a high performance liquid chromatograph which is linked to the mass spectrometer by an atmospheric pressure chemical ionization interface which includes an ionization chamber having a corona discharge electrode formed of a silver or platinum alloy, stainless steel or tinned or non-plated iron. Hagiwara however, does not disclose the use of a reacting gas including fluorine.

U.S. Pat. No. 4,933,548 discloses a method and device for introducing samples for a mass spectrometer. Boyer et al discloses a technique and device for introducing microsamples in the ionization source of a mass spectrometer which heats the microsample and feeds an adjustable flow of reagent for transforming the microsample into a gaseous compound. The disclosed system basically performs a chemical reaction interface (CRI). The reactant gas may include fluorine. When the temperature increases beyond the sublimation point of the metal oxide and reaches the sublimation point of hexaf luorine, feeding of the ion source is begun by opening the valve which feeds the ion source 18 of the spectrometer. The isotopic ratio measurements may be compared with those of standard uranium, hexaf luorine admitted to the spectrometer. However, Boyer does not disclose microwave heating and hence lacks any teaching of a continuous sample flow. Also, Boyer does not utilize an IRMS and accordingly, is incapable of obtaining the quality of results obtainable with the present invention.

U.S. Pat. No. 4,633,082 discloses a process for measuring degradation of sulfur hexafluoride in high voltage systems. Sauers discloses the use of fluorine as a carrier gas.

U.S. Pat. No. 5,086,225 discloses a thermal cycle recirculating pump for isotope purification. The patent discloses the use of fluorine as a carrier gas.

Song and Abramson, *J. Am. Soc. Mass Spectrom.* 1995, No. 6, p, 421–427 describes the use of nitrogen trifluoride as a new reactant gas in chemical reaction interface mass spectrometry for detection of phosphorus, deuterium, chlorine and sulfur. The paper does not disclose or suggest the use of fluorine gas to obtain mass spectrometer resolution between samples which contain carbon and nitrogen.

There is a need in the art of sensitive mass spectrometers and assays which provide mass spectrometer resolution between carbon and nitrogen compounds. When mass spectrometry is performed as is done with most spectrometers, in the presence of oxygen, the mass of carbon and nitrogen containing compounds both overlap around 28, 29 m/z. The present invention overcomes deficiencies of prior art apparatus and methods through their ability to separate overlapping signals with the use of fluorine gas.

DISCLOSURE OF THE INVENTION

The present invention provides for a mass spectrometer apparatus for the sensitive detection of the isotope ratio of elements in a sample by a continuous inline process that converts each element into a new chemical species in an environment comprising fluorine, comprising:

(a) a sample introduction component in which a mixture of analytes is separated into specific molecules, and wherein said sample introduction comprises means for continuous sample introduction into a chemical reaction interface;

(b) a chemical reaction interface (CRI) wherein said CRI converts intact analytes into new element-specific compounds in an environment comprising chlorine; and (c) a mass spectrometer capable of making precise isotopic measurements. The sample introduction component is preferably a gas chromatograph or a high performance liquid chromatograph. The chemical reaction interface is preferably a microwave powered helium plasma interface and the mass spectrometer is a multicollector isotope ratio mass spectrometer.

In a preferred embodiment the sample introduction component is a high performance liquid chromatograph in which both nebulization and countercurrent flow is used to remove a liquid phase through a universal interface. In an alternative embodiment the sample introduction component is a high performance liquid chromatograph and a transport device is used to remove a liquid phase.

In an additional embodiment, the invention advantageously provides for a method for measuring the mass of samples containing carbon and nitrogen compounds comprising:

(a) adding a sample containing carbon or nitrogen compounds to a sample introduction component in which a mixture of analytes is separated into specific molecules, and wherein said sample introduction comprises means for continuous sample introduction into a chemical reaction interface (CRI); wherein said CRI converts intact carbon and nitrogen analytes into new element-specific compounds in an environment comprising fluorine to resolve said compounds; and (b) calculating the isotope ratio of the compounds of said sample with mass spectrometer capable of making precise isotopic measurements.

In a preferred embodiment the spectrometer used is a chemical reaction interface mass spectrometer (CRIMS) or an isotope ratio mass spectrometer system (IRMS). In a preferred embodiment the fluorine reactant gas is NF3 or F2. In an alternative embodiment the sample to be tested also comprises a compound selected from oxygen, phosphorus, deuterium, chlorine, and sulfur.

The above and other objects of the invention will become readily apparent to those of skill in the relevant art from the following detailed description and figures, wherein only the preferred embodiments of the invention are shown and described, simply by way of illustration of the best mode of carrying out the invention. As is readily recognized the invention is capable of modifications within the skill of the relevant art without departing from the spirit and scope of the invention.

DESCRIPTION OF THE INVENTION

Figure 1:
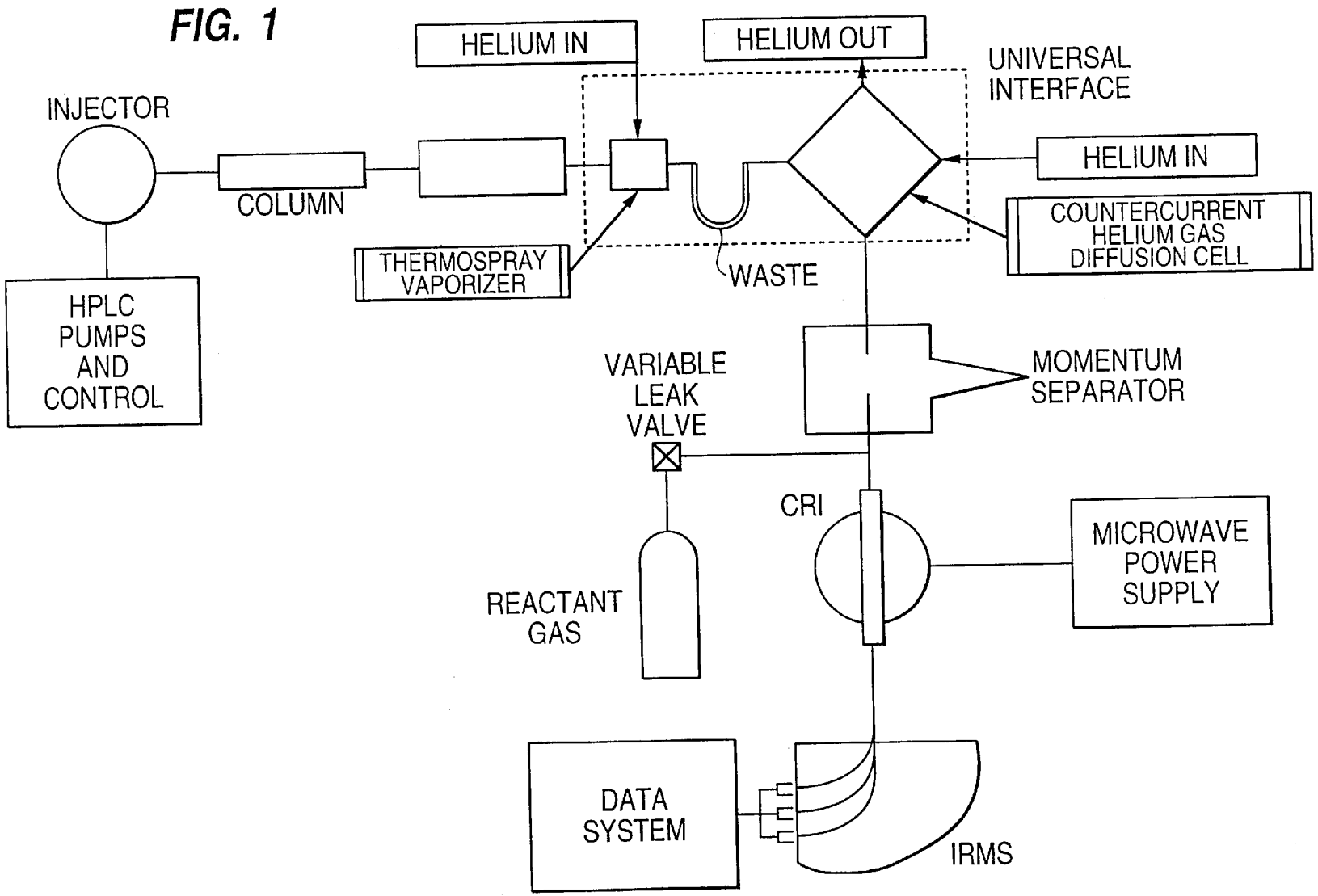
FIG. 1 shows a scheme for the chromatography/mass spectro copy apparatus which is used in a preferred embodiment of the invention.

The invention involves the use of fluorine-based chemistries to generate fluorinated derivatives of the carbon and nitrogen elements contained in various analytes in continuous-flow analyses. By using fluorine, a better and more flexible set of isotope abundance measurements can be made using an isotope-ratio mass spectrometer (IRMS).

The addition of a fluorine-based reactant gas allows a complete chemical transformation of the carbon and nitrogen elements that were originally contained in a given analyte into new molecules from which the elemental and isotopic content of the original fluorination, rather than oxidation or reduction, to generate the new molecules.

The advantages of fluorine or F-based chemistry are as follows:

(1) Fluorine is monoisotopic ($^{19}F$=100%) while the distribution of oxygen isotope is $^{16}O$=99.76%, $^{17}O$=0.04%; and 180=0.2%. The most common measurement made by continuous-flow (CF)-IRMS is for $^{13}C$ where the measured species is $CO_2$. The measured channel of ions weighing 45 mass units includes not only the desired species, $^{13}C^{16}O^{16}O$, but also $^{12}C^{16}O^{17}O$, thus requiring a correction. In contrast, the fluorine product, $^{13}CF_4$, can be measured directly.

(2) In a mass spectrometer, $CO_2$ fragments to produce Co, a species that weighs 28 mass units, the same as $N_2$. Therefore, if the isotope ratio of $N_2$ is to be measured, the $CO_2$ must be trapped before entering the IRMS. This means that one cannot measure both $^{13}C$ and $^{15}N$ enrichment with the same experimental set-up. The production of $CF_4$, rather than $CO_2$, eliminates this problem.

(3) To analyze for isotopes of hydrogen, conventional methods require a complete change in both chemistry and analysis. A reduction rather than an oxidation process is used, and the product is $H_2$. The masses of interest are 2 ($^1H^1H$) and 3 ($^1H^2H$). Using these low masses requires a different analyzer design than is used for N2 (28 and 29) or $CO_2$ (44, 45, and 46). With F-based chemistry, HF is measured at masses 20 and 21 which can use the standard analyzer configuration.

(4) When analyzing Hz there is a reaction $H_2^+ + H_2 - H_3^+ + H$. $H_3^+$ leads to a signal mass at mass 3 which coincides with the mass for $^1H^2H$. This limits the precision and accuracy of measuring $^2H$.

(5) The isotopic composition of two other elements can be examined with the same chemical scheme, namely S and O. Thus, F-based chemistry for the measurement and resolution of carbon and nitrogen compounds is much more comprehensive than the prior methods.

A CF-IRMS instrument may be used in the method of measurement of isotope ratio of samples containing carbon and nitrogen compounds.

CF-IRMS instruments are used in both basic and clinical medicine geochemistry plant physiology, foods and flavors, and oceanography. The subject was recently reviewed (W. Brand, J. Mass Spectrom, Vol. 31, pp. 225–235, 1996).

In FIG. 1, the samples are introduced with a high performance liquid chromatograph (HPLC). Individual components are separated in the column and then pass through an (optional) ultraviolet detector, which is a standard device for HPLC instruments. The liquid stream in which the sample is traveling is then evaporated in the Universal Interface (UI) and the "dry" particles are transported through a momentum separator where what is a high flow of helium is reduced to a much smaller flow suitable for entry into this chemical reaction interface (CRI) and subsequently the mass spectrometer. In the CRI, all chemical species are decomposed to their elements by a microwave-induced helium plasma sustained within an alumina tube that passes through a cavity that focuses the microwave power. The elements liberated in this plasma recombine to form a set of small molecular products the nature of which depends upon the composition of the analyte and the choice of reactant gas used.

If gas chromatographic introduction is used, the output from the column passes directly into the CRI. None of the apparatus from the momentum separator to the HPLC pumps and control is used in this form of the device.

When the reactant gas contains fluorine, up to now such a gas has been $NF_3$ a unique array of small molecular products are generated that have particular applicability to use in an isotope ratio mass spectrometer (IRMS).

A new set of reactions that involve fluorine have been investigated in chemical reaction interface mass spectrometry (CRIMS). This fluorine-rich environment provides new ways to selectively and simultaneously detect oxygen, carbon, nitrogen, phosphorus, hydrogen isotopes, chlorine, and sulfur.

NF3 as a reactant gas provides the most comprehensive array of elemental and isotopic detection yet available for CRIMS. Chemical reaction interface mass spectrometry (CRIMS) is a technique that combines selective detection of elements and their isotopes and conventional mass spectrometry in a single system. With few modifications to an existing mass spectrometry system, CRIMS has been shown to be capable of selective detection of elements and isotopes including 2H, 13C, 14C, 15N, S, Cl, Se, O and Br. It is particularly useful for studying metabolism without the use of radioactive labels, and even without stable isotope labels if a molecule contains an "intrinsic label" such as Cl and S.

Carbon and nitrogen containing compounds are very important in biochemistry, medicine, and environmental sciences. Because of the utility, the lack of availability, and limitations of alternative methods, the development of a strategy enables the selective detection of C, N and P-containing compounds with CRIMS or IRMS.

Experimental

The method of the invention preferably uses an HPLC and a continuous flow isotope ratio mass spectrometer. The component pieces are: 1. a high performance liquid chromatograph (HPLC); 2. a Vestec Universal HPLC/MS interface; 3. a chemical reaction interface (CRI); and 4. an isotope ratio mass spectrometer system (IRMS).

The CRIMS provides an extensive range of CRI-MS applications using capillary gas chromatography coupled to conventional mass spectrometers; and the recent development of an interface to the CRI for HPLC that makes this approach possible. The unique chemistry of the CRI improves 15N determinations compared with classical combustion methods. This type of instrument offers researchers who use isotopes and IRMS an expanded range of target molecules including intact biological polymers. Compared to HPLC/conventional MS approaches, 13C and 15N are selectively detected at greatly reduced isotopic abundance.

In addition, intact biological macromolecules can be analyzed directly by the CF-IRMS for isotopic quantitation. This greatly improves analyses in biological systems where either 14C is a tracer or where the tedious sequence of hydrolysis followed by chromatographic separation and MS analysis of selected. monomers is required.

The Chemical Reaction Interface

A preferred apparatus for use in the assay of the invention uses a microwave-powered chemical reaction interface (CRI). This device decomposes analytes and reformulates them into small molecules whose spectra permit selective detection of stable isotopes in organic molecules in a manner that is independent of the structure of the original analyte molecule; a characteristic otherwise requiring radioactivity. Most of the use of the CRI involve chromatographic separations and detection with a single-collector, rapidly scanning mass spectrometer (MS).

An Isotope-Ratio Mass Spectrometer.

The multiple collector arrangement of an isotope-ratio mass spectrometer (IRMS) provides the ability to detect enrichments orders of magnitude below what can be achieved with conventional mass spectrometers. A Universal HPLC/MS Interface A universal interface (UI) is capable of essentially complete removal of HPLC solvent from the analytical sample stream. It uniquely enables HPLC introduction to the CRI, as even 1/100,000 retention of the solvent could overwhelm its chemistry. This elevates the CO2 baseline in the IRMS. In collaboration with Vestec Inc. (now a division of PerSeptive Biosystems), the inventor has produced a CRI-MS instrument that separates mixtures with high performance liquid chromatography rather than gas chromatography as has been the previous introduction method.

Figure 2:
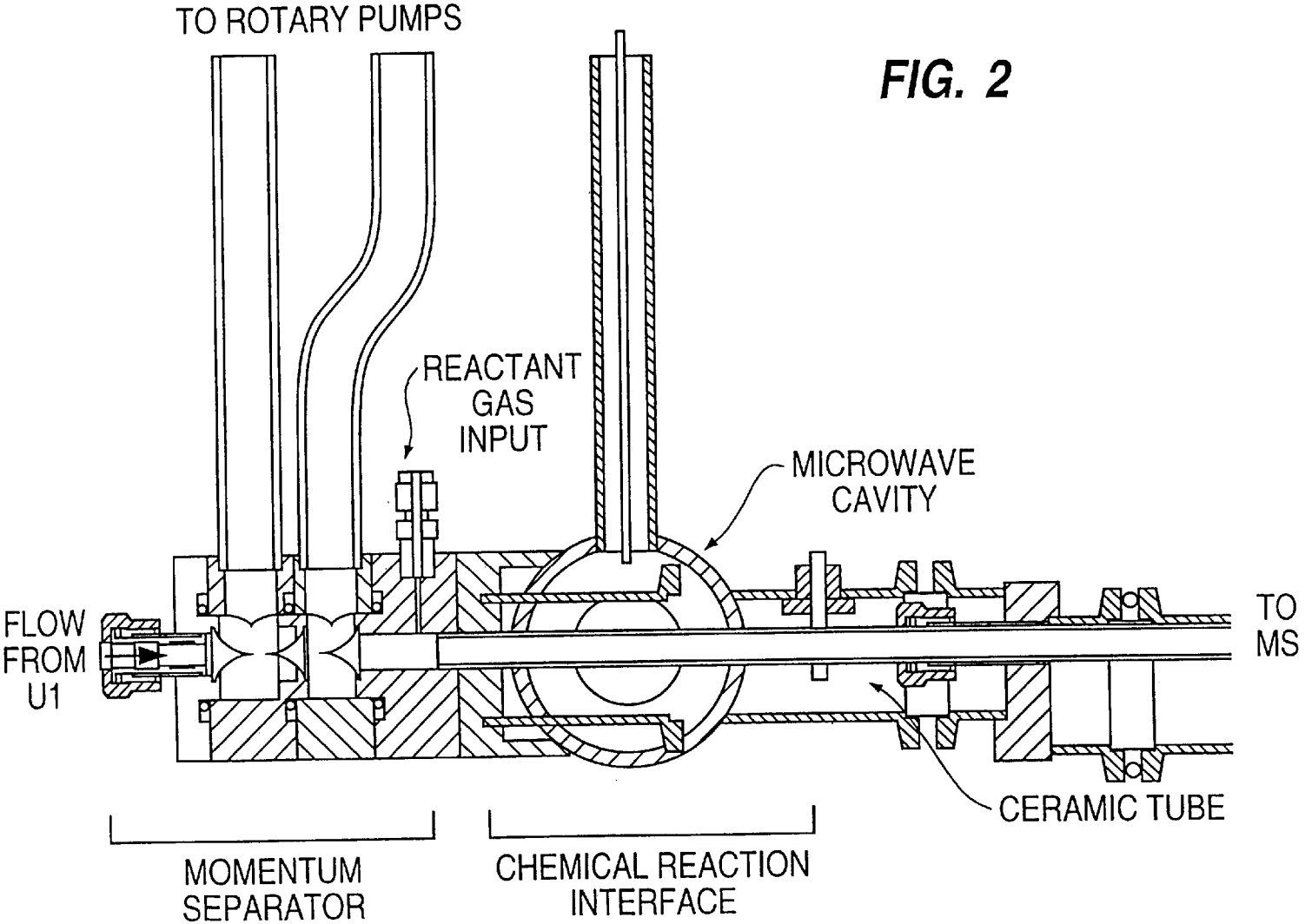
FIG. 2 shows a schematic of CRI-MS probe for HPLC introduction with Vestec Universal Interface.
Figure 3:
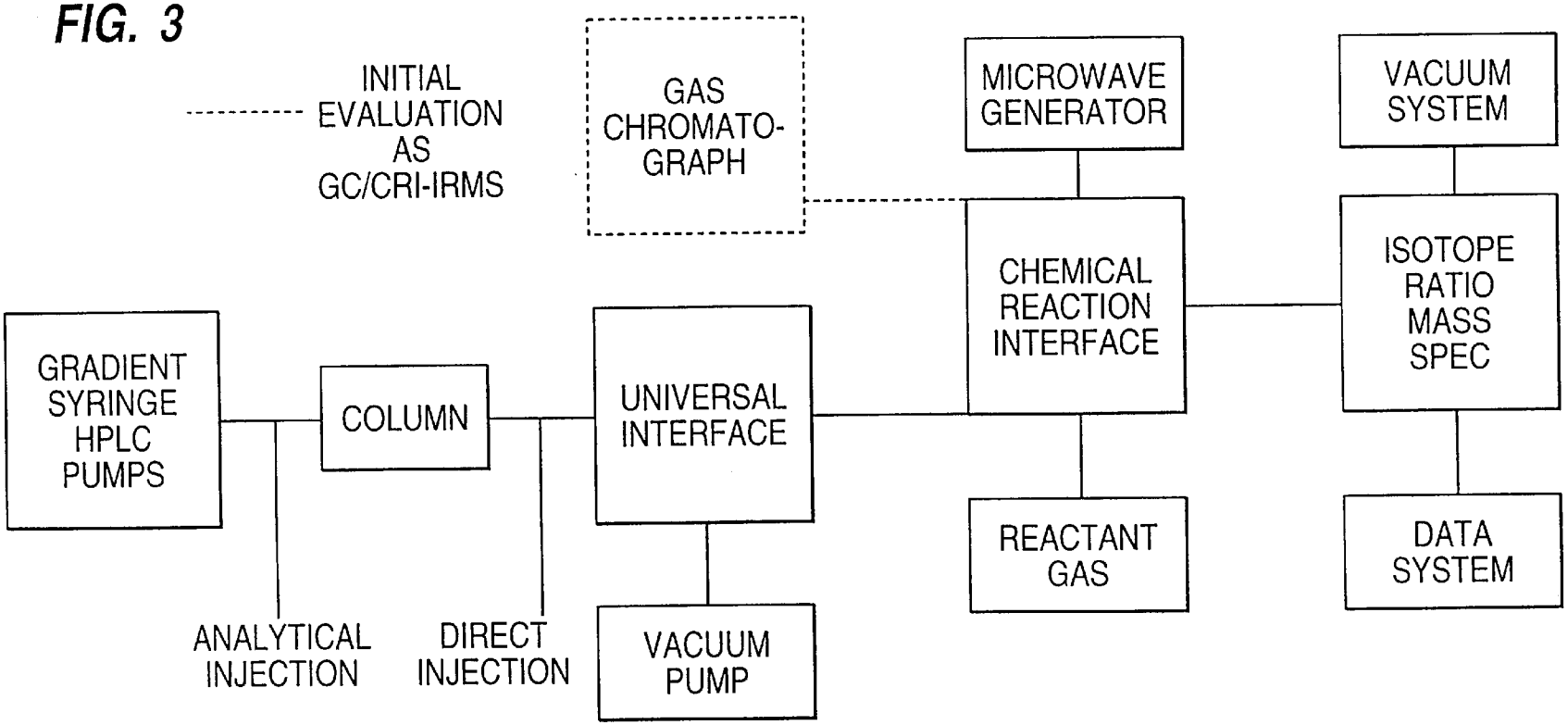
FIG. 3 shows a block diagram of instrument assembly.
Figure 4A:
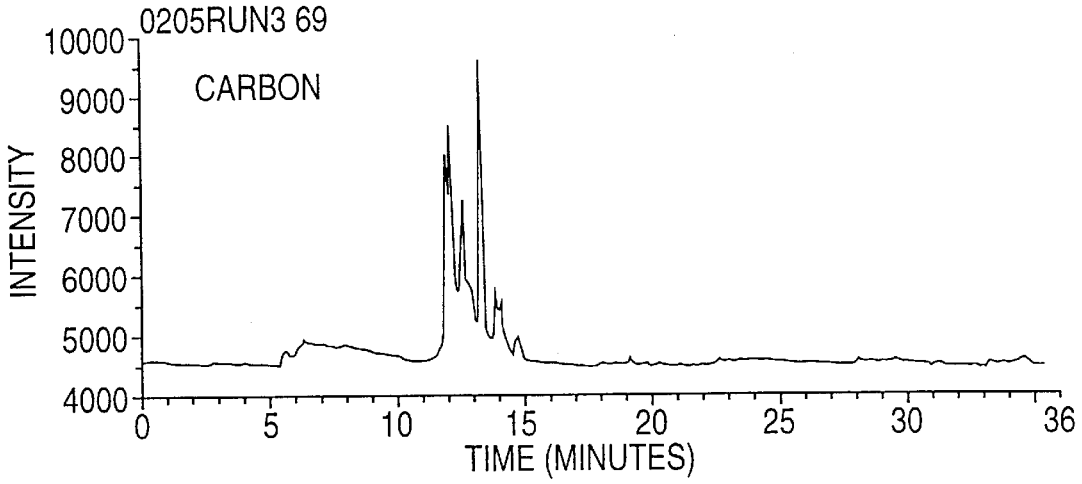
FIG. 4 shows an HPLC/CRIMS chromatogram of sample G40 using $NF_3$ as the reactant gas.
Figure 4B:
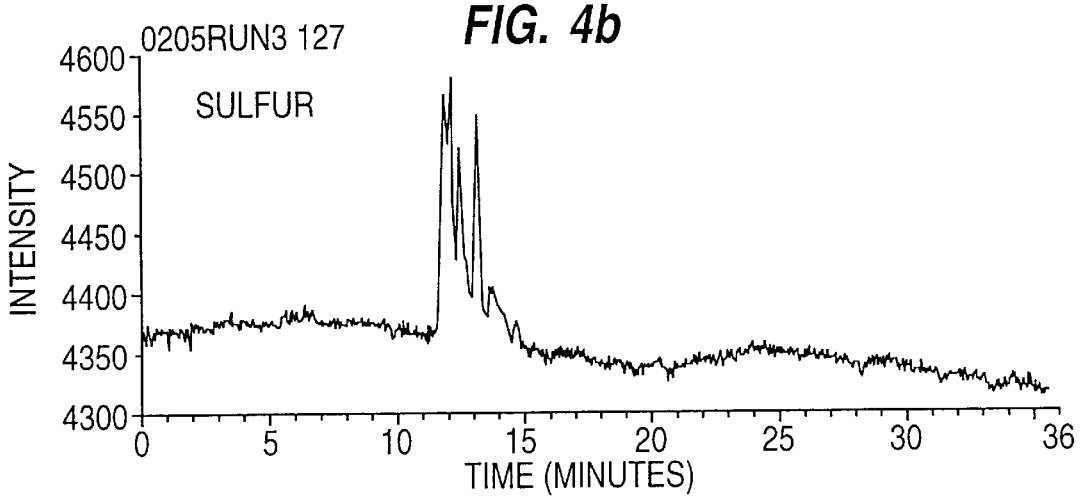
Figure 4C:
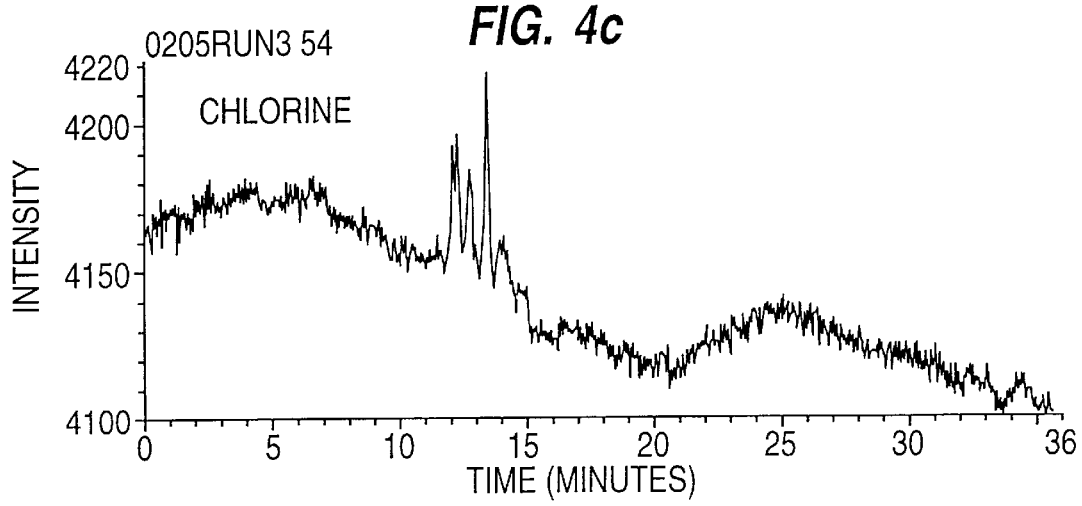

A device as shown in FIG. 1 first desolvates a thermospray-nebulized effluent in a helium stream, then removes the residual vapor with a helium countercurrent (V1). Less than one part in $10^6$–$10^8$ of solvent are retained. Following a momentum separator (FIG. 2) to reduce the L/min flow of helium to a mL/min flow, the sample stream is characterized by an extremely "dry" array of analyte particles in He. Other than moving belts, this appears much better than other HPLC/MS interfaces. The outflow of the UI is appropriate for introduction to the CRI which normally operates with analytes carried in a 1–2 mL/min stream of He. The inventor's work to date has generated a design that effectively couples HPLC, the UI, and the CRI to both magnetic sector MS, conventional quadrupole MS and IRMS.

This apparatus provides a new analytical concept, HPLC/CRI-IRMS for diagnostic assays, particularly those of biological and pharmacological importance. The detection of stable isotopes in compounds as simple as urea, and amino acids, and as complicated as DNA may be performed on this apparatus.

The CRI provides an alternative to the combustion system that is the "standard" for IRMS instruments that use gas chromatographic introduction. The advantages of the CRI are: an essentially unlimited supply of oxidizing gas compared to the limited capacity of a CuO combustor or other chemical reactors; the detection of nitrogen as NO, thus avoiding the problems of interference between CO and N2; and the ability to vary the chemistry to monitor a wider range of isotopic species, such as 180 or 34S.

The increasing use of HPLC in biological chemistry shows that an HPLC/IRMS instrument is a major advance by assisting in metabolic studies of materials that are not appropriate for GC. Beyond the ability of HPLC to introduce samples that require separation, using flow injection (i.e., post-column introduction directly into the solvent stream) of previously purified samples, a greatly widened range of materials could be provided by the CRI interface, in particular intact biological macromolecules.

The apparatus provides high precision isotopic determinations which would greatly reduce analysis time for these large molecules which now have to be degraded to monomers (or small oligomers) which then have to be further purified, separated, and analyzed before knowing how much of a particular label has been incorporated. The complication of aberrant isotopic character of carbon-based derivatization procedures that are frequently required for GC will be negated in high precision IRMS measurements with HPLC.

In general, stable isotopes are favored in human experimentation, since they are free of the risks associated with radioisotopes. Because there are no radioisotopes of nitrogen, the use of 15N as a tracer is particularly significant. The enhanced detection limits of an IRMS compared to a conventional MS means that human and other tracer experiments will be more readily accomplished.

Isotope Ratio Measurements in Biological Systems

Isotope ratio mass spectrometry in biological systems stems from the late 1930s with the pioneering work of Rittenberg. In general, a suitably prepared sample is converted off-line, frequently by combustion in a sealed tube, into small polyatomic species such as CO2, N2, and H2O. This gas is introduced into a multicollector mass spectrometer under controlled conditions over a long period of time so that the 45/44 [i.e. (13C1602+12C170160)/12C1602 ratio is precisely determined. This approach will be referred to as "off-line combustion IRMS".

The aspect of IRMS which is particularly applicable dates from 1976. Sano et al. (S1) first described an instrument where a GC, a combustor, and an IRMS are coupled together. The next precedent is provided by Matthews and Hayes (M3). Without use of a multicollector IRMS, they obtained high precision, low abundance detection of 13C and 15N. With this approach, they could measure 0.02 APE* for 13C from 9 nmol of methyl octanoate.

*Atom Percent Excess (A.P.E.) is the difference between the isotope ratio of an unknown minus the isotope ratio of a standard [IR(x)−IR(std)] times 100, divided by [1 +IR(x)−IR(std)].

In comparison, the technique involving off-line combustion followed by a dual inlet, dual collector IRMS measurement required 230 nmol to produce this measurement, albeit with a 5-fold better precision. Matthews and Hayes reported that this apparatus could detect 0.2 pmol excess 13C in a sample containing 10 nmol of carbon. For nitrogen, they examined plasma amino acids and concluded that 4 pmol excess 15N could be determined in 100 nmol of nitrogen.

In 1984, Barrie et al. (B1) coupled a gas chromatograph and a multicollector stable isotope ratio mass spectrometer using a combustion interface much like Matthews and Hayes. In general, their results compared to dual inlet dual collector IRMS agreed within a δ13C** of 2, i.e., a 0.2% error. The authors concluded that:

"We would expect the gas chromatography/SIRA [stable isotope ratio analyzer] technique to reduce the quantity of labelled compound required by at least a factor of 10 and to permit new studies to be undertaken where labelled compounds are only available at enrichments too low to be utilized using GC/MS/SIM (selected ion monitoring]".

*The δ (per mil) notation denotes the relative difference in isotope ratio between an unknown and a standard: δ=[IR(x)−IR(std)]/IR(std)·1000.

There are two commercially available GC/combustion/IRMS instruments; e.g. Finnegan MAT Delta C, that follows this design strategy. Published data indicate that the system can obtain precision comparable to that obtained with off-line combustion IRMS analysis.

The concept of continuous flow GC/isotope ratio measurements has been clearly defined and evaluated. When the GC and combustor are coupled to a single-collector mass spectrometer** which switches peaks between masses and detects with an electron multiplier, substantially better performance is realized than from straightforward selected ion recording GC/MS experiments. When coupled with a mass spectrometer with multiple Faraday collectors, the GC/combustor/IRMS appears to produce nearly as good a result as off-line combustion IRMS methods, but from substantially less material. Obviously, the need to obtain purified specimens and to manipulate them prior to the IRMS measurement is obviated by the in-line GC and combustor.

**A single-collector or "conventional" mass spectrometer refers to any instrument that jumps, scans, or detects two masses sequentially, rather than simultaneously. In this context, most quadrupole, magnetic sector, ion trap, and time of flight mass spectrometers are single-collector.

One other IRMS technique is the coupling of an elemental analyzer, a GC, and an IRMS. This was first accomplished for both 13C and 15N in 1985 (P2). With this combination, a packed column GC separates the fixed gas combustion products N2 and CO2 before they flow into a dual collector IRMS. It appears to be an efficient system for preseparated or unseparated materials, but cannot be continuously coupled to another separation device (i.e. GC or HPLC) because each analysis takes several minutes.

The Background of CRIMS

Markey and Abramson (M1, M2) developed the chemical reaction interface: a microwave-powered device which completely decomposes a complex molecule to its elements in the presence of helium. The addition of a reactant gas, for example oxygen, generates stable oxidation products that reflect the elemental composition of the original analyte and are detected by a single-collector mass spectrometer. The general characteristics of this process, although greatly simplified, are illustrated in the following scheme.

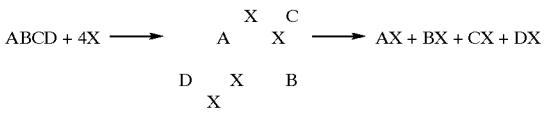

A complex molecule composed of elements represented by the letters A B C and D is mixed with an excess of reactant gas X in a stream of helium. In a CRIMS analysis, if B is an isotope or element of interest, it can be monitored with a characteristic mass from BX with any MS. A schematic of a GC/CRIMS apparatus is shown in FIG. 1 of Reference C1. The combination of capillary gas chromatograph and a chemical reaction interface-mass spectrometer (GC/CRIMS) allows the analyst to selectively detect stable-isotope labeled substances as they elute. If the molecule BX has been selected to monitor a specific isotope, say at M+1, a chromatogram showing only enriched BX will be generated with Equation 1.

Enriched BX=BX at M+1−Nat. abund. of M+1 expected from BX at M. (Eq. 1).

This equation removes the contribution from the naturally abundant isotopes in BX, thus leaving only the M+l from BX that arises from the tracer. This provides the isotope-selective detection capability of CRIMS.

CRIMS is a sensitive, selective, and reliable method for detecting and quantifying isotopes or elements in biological systems. Various CRIMS experiments have successfully used urine, plasma, tissue extracts, isolated hepatocytes in culture, and cell culture media with no matrix problems.

The inventors use the IRMS to evaluate enzyme-dependent differences in isotopic abundance of analytes from natural origin. Isotopic analyses of intact biological macromolecules are valuable because the time-consuming steps of hydrolysis and derivatization area avoided.

EXAMPLE 1

Differention of Human Growth Hormone Samples Based on their $^{13}C/^{12}C$ ratio.

Because the *E. coli* that are used to produce biosynthetic proteins might be grown in sources of nutrients that were of various origins, it is possible that the isotopic signature of recombinant proteins might differ from endogenously produced molecules as does testosterone. To examine this hypothesis, the inventors obtained the three rhGH samples along with GH derived from human pituitary glands. Each recombinant sample was dissolved in distilled water according to the instructions provided on each vial. The pituitary GH was dissolved in 0.03M $NaHCO_3$ and 0.15M NaCl according to instructions received with it. Twenty $\mu$L samples were injected into a recently-developed high performance liquid chromatograph/isotope ratio mass spectrometer a(HPLC/IRMS) system that uses the chemical reaction interface (CRI) to convert analytes into $CO_2$ for isotope ratio measurement.

As a condensed-phase internal standard, the inventors used horse albumin with an isotope ratio measured as −21.03 $\delta^{13}C$ % by off-line combustion and a conventional gas inlet IRMS method. Each injection contained 2 $\mu$g of albumin (30 pmol) and 2–3 $\mu$g (100–150 pmol) of rhGH. The mobile phases were 0.1% trifluoroacetic acid (TFA) and acetonitrile also containing 0.1% TFA. After a 2 minute hold at 30% acetonitrile, the solvent composition was increased to 70% acetonitrile in 10 minutes with an Isco Model 260 dual syringe pump system. The flow rate was 1 mL/min. The separation was carried out using a PerSeptive Biosystems Poros R2 column (30 mm long, 2.1 mm id). A Finnigan/MAT Delta S IRMS with Isodat software was used to measure the isotope ratios. Oxygen was the reactant gas for the CRI.

In $\delta^{13}C$‰ terms, the mean and SD values for these preparations are: human pituitary, −11.31±0.71; Genentech Nutropin®, −12.84±0.90; Genentech Protropin®, −10.25±0.56; Lilly Humatrope®, −18.47±0.50 (n=7–8). In each case, the observed isotope ratio was different from pituitary GH ($p<0.05$ by Student-Newman-Keuls multiple comparisons). In practical terms, only the Lilly product has a carbon isotope ratio that is markedly different from pituitary GH. One should also realize that the carbon isotopic signature measured on the biosynthetic samples could change considerably from one lot to another if a manufacturer changed sources for the components in the *E. coli* growth media.

EXAMPLE 2

Mass Balance Studies.

The invention improves performance with stable isotopes so that radioisotope use can be diminished. One particular "standard" method that uses radioactivity is in mass balance studies. A labeled substance is given to some biological system and fractions from that system are examined for their label content. Typically this label is 14C, and scintillation spectrometry effectively counts the amount of label regardless of its chemical form. If one were using an animal, biological specimens like urine, bile, feces, saliva, etc. are taken. If a cell system, one might count uptake into the cells. The inventor have evaluated the direct introduction HPLC/CRI-IRMS system for this purpose.

The inventors have examined the capability of the new HPLC/CRI/IRMS instrumentation to detect trace amounts of a $^{13}$C-labeled drug in urine. The approach uses flow injection to transmit a urine sample into a desolvation system prior to combustion to $^{13}c0_2$ by a microwave-powered chemical reaction interface. The ability of this apparatus to quantify less than 50 ng/ml of excess $^{13}$C (~0.5 μg/ml of $^{13}C_2$-labeled aminopyrine) is superior to previous detection limits for $^{13}$C in urine that use off-line combustion methods. These results support previous findings that mass balance studies could be carried out with IRMS, here using doses as low as 1 mg/kg.

TABLE 1

Summary of CRIMS chemistries.

| Element or isotope | Product[a] | Mass[a,b] | Reactant | Reference |
|---|---|---|---|---|
| $^{1,2}$H | $^{1,2}$HF | 20, 21 | $NF_3$ | 24, 25 |
| H | $H_2O$ | 18 | $SO_2$[c] | 9 |
| $^{2}$H | $^{2}H^{1}H$ | 3.022 | $H_2$ | 9 |
| $^{12,13}$C | $^{12,13}CO_2$ | 44, 45 | $SO_2$ | 9 |
| C | CO | 28 | | 9 |
| $^{14}$C | $^{14}CH_4$ | 18.034 | $H_2$ | 4, 5 |
| C | $CH_4$ | 16 | | 5, 9 |
| | $C_2H_2$ | 26 | | 5, 9 |
| | HCN | 27 | $N_2$ | 5 |
| $^{12,13}$C | $^{12,13}CF_4$ | 69, 70 ($CF_3^-$)[d] | $NF_3$ | 24, 25 |
| $^{14,15}$N | $^{14,15}$NO | 30, 31 | $SO_2$ | 9 |
| | $N_2$ | 28, 29 | | 6, 9 |
| | $NO_2$ | 46, 47 | | 6, 9 |
| N | HCN | 27, 28 | $H_2$ | 5, 9, 19 |
| O | $H_2O$ | 18 | $H_2$ | 19 |
| $^{16,18}$O | $C^{16,18}O$ | 28, 30 | | 19[e] |
| P | $PF_5$ | 107 ($PF_4^+$) | $NF_3$ | 24, 25 |
| S | $S^{35,37}Cl$ | 67, 69 | HCl | 20 |
| | $SF_6$ | 127 ($SF_5^-$) | $NF_3$ | 24, 25 |
| Cl | $H^{35,37}Cl$ | 36, 38 | $SO_2$ | 21, 22 |
| | $F^{35,37}Cl$ | 54, 56 | $NF_3$ | 24, 25 |
| Se | $^{80}Se^{35,37}Cl$ | 115, 117 | HCl | 23 |
| Br | $H^{79,81}$ Br | 80, 82 | $SO_2$ | 21 |

[a]Only those species that are useful for more than one isotopic variant are indicated with multiple masses.
[b]Where the exact mass is indicated, high resolution is required to obtain the selective result.
[c]Where $SO_2$ is indicated as the reactant gas, other oxidizing gases such as $O_2$ will give the same products, but with different yields.
[d]We presume that $^{13}$C-selective detection is possible, but have not yet demonstrated it.
[e]$O^{18}$ detection is from this laboratory (unpublished).

The inventors have also analyzed selected elements or isotopes using a direct probe as a means of introducing samples into CRIMS. A linear signal was observed for the SO2 produced from the oxidation of polymethionine for amounts down to 20 ng. A good correlation (r=0.80) between the theoretical and observed S/C atomic, content at the 1 μg level of 12 proteins of varying composition was found.

EXAMPLE 3

Evaluation of Fluorine Chemistry in CRIMS.

In the following examples, the GC/CRIMS system used was a Hewlett-Packard 5890II/5971A MSD equipped with a 30 m×0.25 mm id×0.1 μm film thickness DB-5 capillary column. A microwave-powered chemical reaction interface (CRI) is installed in the GC oven between the column and the inlet of MSD. The helium flow was 0.5 ml/min. A Swagelok T was used to couple the column, the CRI, and the reactant gas tube. The reactant gas flow is not measured, but it must represent just a small fraction of total gas flow because substantial amounts of the reactant gas quench the helium plasma (17). The CRI consists of a ¼" o.d.×1/16" i.d.×5" long alumina tube and a stainless steel microwave cavity which is used to transmit microwave power from a 100W, 2450 MHz generator. A Teknivent Vector 2 data system was used to control the MSD and to process the data. In all experiments, 1 μl of a given solution was injected in splitless mode, the acquisition of data was started 5 minutes after injection to allow the solvent front to pass, and then the microwave-induced plasma in the CRI was ignited.

Depending on the analysis being done, the MS could be set in selective ion monitoring (SIM) mode for any or all of the masses indicated below. The following reactions indicate the elements, the products, the fragment ions, and masses at which the species are detected:

C→$CF_4$ ($CF_3^+$, m/z 69)

H→HF ($^1$HF+, m/z 20; $^2HF^+$, m/z 21)

O→$F_2O$ ($F_2O^+$, m/z 54)+other oxygen/fluorine products

P→$PF_5$ ($PF_4^+$, m/z 107)

Cl→ClF ($^{35}ClF^+$, m/z 54; $^{37}ClF^+$, m/z 56)

S→$SF_6$ ($SF_5^+$, m/z 127)

Carbon detection: All compounds selected contain carbon, so this signal was not selective. Carbon was monitored at m/z 69.

Nitrogen detection: in the CRI, $NF_3$ is totally dissociated to give $N_2$ and $F_2$. Therefore, compounds containing nitrogen cannot be detected because of the high background. This total dissociation of the relatively stable $NF_2$ indicates that $N_2$ would be the product of any nitrogen-containing analyte if $F_2$ was the reactant gas rather than $NF_3$ and nitrogen detection could be accomplished by monitoring m/z 28 and 29.

Phosphorus detection: A series of solutions of TBOEP from 1 ng/μl to 1000 ng/μl was prepared in toluene with TBP as the internal standard (10 ng/μl). The GC column temperature was initially 90 ° C. for 2 min, then programmed to 140 ° C. at a rate of 40 OC/min, then to 270 ° C. at 10 ° C./min and held for 5 min. The SIM program used m/z 20, 69 and 107.

Deuterium detection: Deuterium labeled amino acids were used as the samples. A group of solutions in water was prepared with L-phenylalanine-$d_8$ concentrations from 69 pg/μl to 69 ng/μl, L-leucine-$d_{10}$ and nonlabeled L-phenylalanine at constant concentrations (65 ng/μl and 63 ng/μl). These solutions were derivatized by the following procedure: 100 μl of solution was dried, 50 μl of MSTFA and 50 μl of dried acetonitrile were added and heated at 100 ° C. for 30 min in a sealed reaction vial. The GC column was set at 70° C. for 2 min, programmed to 100° C. at a rate of 30 ° C./min and held for 1 min, then programmed again to 200° C. at 15° C./min and held for 5 min. SIM mode used m/z 20, 21 and 69.

Sulfur detection: L-Methionine solutions were prepared in water at concentrations from 66 pg/μl to 66 ng/μl with L-cysteine as the standard (24.5 ng/μl). The solutions were derivatized as described above. The GC column was set at 70° C. for 2 min, programmed to 130° C. at a rate of 40 OC/min, held for 3 min, programmed again to 150° C. at 2.5° C./min, then to 250° C. at 20° C./min and held for 1 min. The MSD was in SIM mode using m/z 69 and 127.

Chlorine detection: A series of diazepam solutions was prepared in toluene from 0.68 ng/μl to 680 ng/μl with DDT as the internal standard (7.2 ng/μl). The initial GC temperature was set at 70° C. for 2 min, programmed to 210° C. at 30° C./min, and then to 250 at 10° C./min and 210 held for 5 min. The MSD was set in SIM mode with m/z 20, 54, 56 and 69.

A mixture of eight compounds was used to demonstrate the simultaneous and selective detection of all these targeted species: nitrobenzene-$d_5$, TBP, caffeine, thiopental, methyl palmitate, methyl stearate, TBOEP, and diazepam. The concentrations of these compounds were not precisely measured, but are about 100, 10, 150, 100, 150, 300, 30, and 150 ng/μl, respectively following their evaporation and reconstitution in toluene. Amino acids were not used because they required derivatization and increased the complexity of the sample. The GC temperature was set at 70° C. for 2 min, programmed to 120° C. at 30° C./min, and then to 250° C. at 10° C./min and held for 5 min. The MS was set in SIM mode with m/z 20, 21, 56, 69, 107, and 127.

The plasma sample from the patient receiving cyclophosphamide was processed in the FDA laboratories according to the following scheme. Reactive metabolites were trapped by collecting blood samples in tubes containing 2 ml of acetonitrile, 1 ml of methanol, 1 ml of 2 M monobasic sodium phosphate (pH 4.6) and 250 μl of a methanol solution containing O-pentafluorobenzylhydroxylamine HCl (50 mg/ml), and the O-pentafluorobenzyloxime derivative of $^2H_4$-aldophosphamide (16 μg/ml). After at least three hours, the samples were centrifuged, and the supernatant was removed and mixed with 1 ml of $CHCl_3$. After vortexing, 1.6 ml of the lower organic layer was removed, evaporated, and the residue was silylated at room temperature for one hour by adding 250 μl of acetonitrile and 60 μl of N-(t-butyldimethylsilyl)-N-methyltrifluoroacetamide.

Once an analyte from a chromatographic column enters a CRI carried in helium and mixes with the reactant gas, both analyte and reactant gas are decomposed into atoms by a microwave powered plasma. As atoms leave the reaction chamber, they recombine to form small molecules according to their chemical thermodynamic characteristics. A mass spectrometer in selected ion monitoring mode serves as the detector to selectively measure those newly formed molecules. The mass spectrometer response provides both qualitative (which elements or isotopes are present) and quantitative (how much of that element or isotope is present) information.

Prior to investigating fluorine chemistry, CRIMS reactant gases studied can be classified into two categories based on their chemical characteristics; oxidative or reductive. Oxidative reactant gases are $O_2CO_2$, and $SO_2$ and reductive gases are $H_2$, HCl, $NH_3$, and $N_2$. The inventors original strategy for generating a volatile, stable CRIMS product containing phosphorus was based on the observation by Matsumoto et al. (18) that $PH_3$ could be generated from phosphate in a reductive environment. The efforts to use these gases for the selective detection of phosphorus containing compounds were not successful.

A new chemical strategy using a fluorine-rich environment in the reaction interface was evaluated. Initially, $SF_6$ was used as the fluorine source. With $SF_6$ as the reactant gas, phosphorus was converted into $PF_5$ and could be selectively detected at m/z 107 ($PF_4^+$), the most abundant peak in the $PF_5$ mass spectrum. This was the first successful CRIMS experiment to selectively detect phosphorus.

However, $SF_6$ was not a good reactant gas for several reasons. First, the P-selective detection channel, m/z 107, could be interfered with by $^{34}S^{16}OF_3^+$, a CRIMS product of $SF_6$ and $O_2$. In addition, $SF_6$ is inherently very stable and did not seem to generate a highly reactive fluorinating environment. It did, however, prove the concept that a CRIMS chemistry using fluorine could yield a P-selective species.

Using the more reactive $NF_3$ was a success. The chemistry for $NF_3$ is similar to that of $SF_6$ except that $NF_3$ does not reform itself readily, but yields $N_2$ and $F_2$ as products to a major extent. $SF_6$ preferentially recombined. With abundant fluorine, not only did $PF_5$ form readily, but other species were noted according to the reactions listed above.

Not only does this fluorine-generating scheme provide P-selective detection, it is good for several other elements such as Cl and S and their isotopic content, as well as the isotopes of hydrogen, carbon, and presumably nitrogen and oxygen. ClF is the CRIMS product for chlorine from organic compounds. Both m/z 54 and m/z 56 can be used as the detection channel. However, m/z 54 could be interfered with by $SF_4^{++}$, which is part of the mass spectrum of $SF_6$, a CRIMS product when sulfur is present. Another concern was that $F_2O^+$, at m/z 54, could be a CRIMS product of oxygen, although no peak appeared in the m/z 54 channel in experiments with oxygen containing compounds. It would appear that if there are no sulfur containing compounds present, m/z 54 could be used since it provides a three fold more abundant species than the m/z 56 channel. The selective detection channel for sulfur containing compounds is m/z 127 ($SF_5^+$), the base peak in the mass spectrum of $SF_6$. $SF_6$ is the primary CRIMS product of sulfur in the fluorinating environment.

Hydrogen fluoride appears as the main CRIMS product of hydrogen atoms from organic compounds. The inventors find that m/z 20 and 21 can be used to selectively measure H and D. While m/z 20 provides a general detection channel for unlabeled organic compounds, m/z 21 is selective for deuterium-containing compounds. The previous scheme for selectively monitoring deuterium used $H_2$ as the reactant gas and monitored HD at m/z 3.022 with a resolving power of 2000 (2,14). Its two disadvantages were that it required a high-resolution mass spectrometer, and could neither monitor hydrogen nor measure D/H ratios because of the large amount of $H_2$ that was used as the reactant gas. The procedure described here avoids both of these problems.

$CF_3^+$(m/z 69) can be used as a general carbon detection channel. Monitoring m/z 70 should provide a channel for $^{13}C$ detection and the m/z 70/69 ratio will yield a carbon isotope ratio.

Phosphorus: To determine the sensitivity and dynamic range, a series of TBOEP solutions in toluene were used. The ion at m/z 107 was used as the selective channel. With an integration time of 300 milliseconds, a detection limit of 1 ng of TBOEP was achieved with a signal to noise ratio greater than three. With an ~8 second peak width at half-height, this equates to 10 pg/s for elemental phosphorus detection. As discussed below, this level of sensitivity is at least an order of magnitude higher than would be expected with the best CRIMS instrumentation. The linear dynamic range is at least three orders of magnitude and a correlation coefficient ($R^2$) of 0.997 was obtained. Reproducibility was determined by repeatedly injecting a sample contained 100 ng/μl of both TBOEP and TBP. For the area ratio of the two components, a relative standard deviation (RSD) of 3.2% was obtained with n=5.

Deuterium: Phenylalanine-$d_8$ and leucine-$d_{10}$ were used to determine the sensitivity and linear dynamic range. The results show that the linear dynamic range is more than two orders of magnitude with a correlation coefficient of 0.994.

Reproducibility experiments showed an RSD of 2.9% (n=5) for the area ratio of 60 ng of leucine-$d_{10}$ to phenylalanine-$d_8$ internal standard. In a separate experiment, the detection limit was found to be 60 pg of phenylalanine-$d_8$ with an integration time of 300 milliseconds, and S/N>5 .

Deuterium enrichment was studied with a group of samples containing different amounts of L-phenylalanine-$d_8$ and a constant amount of unlabeled L-phenylalanine as their diTMS derivatives. The D/H ratio for the CRIMS method was obtained from the peak areas in the m/z 21 (D) and m/z 20 (H) chromatograms. The inventors found some nonlinearity when plotting the experimental D/H ratio against the "theoretical data", especially when the concentration of L-phenylalanine-$d_8$ was low. To examine this problem, another D/H ratio was obtained in the "normal" GC-MS mode (with the CRIMS power turned off), by measuring the peak area ratio from the SIM chromatograms of m/z 200 (M-COOTMS for -$d_8$) and m/z 192 (M-COOTMS for -$d_0$), which are the most abundant MS peaks of labeled and unlabeled diTMS phenylalanine. The 200/192 ratio then was converted into a D/H ratio by considering the fraction of H atoms in diTMS phenylalanine-$d_8$. The inventors found that these two methods, CRIMS and normal GC-MS, agreed closely with each other for the deuterium enrichment experiments. The correlation coefficient is 0.9961 and the slope is 0.94. When regressed against theoretical data, the correlation coefficient was 0.9871 and the slope was 0.81. The nonlinearity mentioned above may be due to errors in the concentrations or purity of the samples, or with other instrumental problems such as ion-molecule reactions (19) or amplifier nonlinearity, but not with the CRIMS analyses.

Sulfur: A group of solutions of sulfur-containing amino acids was used for the this study. L-methionine was used as the sample and L-cysteine was used as the internal standard. The detection was linear from 200 pg to 66 ng of methionine. The 66 ng figure is not necessarily the upper limit of the linear dynamic range, although 200 ng of L-methionine produced a deformed peak indicating either the chromatography or the chemistry in the CRI was not right. A detection limit of 200 pg of L-methionine was obtained with a integration time of 400 milliseconds and signal-to-noise ratio of three. An RSD of 4.4% (n=5) was obtained with 20 ng of L-methionine and 24 ng of L-cysteine.

Previously, when the HP 5971A MSD was used with $SO_2$ as the reactant gas, the detection limit was 1 ng of diazepam (17). This is comparable with the present work with $NF_3$ as the reactant gas, which provided a 2 ng limit for the same compound. That report (17) also included a performance comparison of the Extrel C50/400 and HP 5971A MSD under several conditions. While the 2 ng detection limit for Cl does not appear as good as the 50 pg value from a previous study (9) with $SO_2$ as the reactant gas, that result was achieved on the Extrel instrument with its special 2.1 MHz power supply that maximizes the transmission and resolution at low mass ranges.

Chlorine: Chlorine-containing compounds can also be selectively determined. As was done previously (9), a group of diazepam solutions was prepared in toluene, with p,p'-DDT as the internal standard. The ion at m/z 56, or $^{37}ClF^{+\cdot}$, was used as the selective detection channel. The detection limit is 2 ng of diazepam with a signal to noise ratio of three and an integration time of 300 milliseconds. A linear dynamic range of three orders of magnitude has been achieved with a correlation coefficient of 0.9996. A reproducibility test with a sample of 130 ng diazepam and 50 ng DDT showed an RSD of 3.4% (n=4).

Carbon: The masses used for carbon detection are unique, and such uniqueness for those masses implies selectivity. The carbon channel was detected for all materials injected, indicating high sensitivity.

Nitrogen: As discussed earlier, using $NF_3$ negates the ability to monitor nitrogen content in the substances eluting into the CRI.

Selectivity

To study the selectivity, a mixture of eight compounds containing various elements was prepared. The ion at m/z 20 was used to monitor the hydrogen contained in all the organic compounds, and m/z 21, 56, 107, and 127 were used to simultaneously detect deuterium-, chlorine-, phosphorus-, and sulfur-containing compounds, respectively. The results show chromatograms of these channels, all of which appear to be highly selective.

Application to Detection of Phosphorus-Containing Drugs

Cyclophosphamide is an anti-cancer drug that contains one phosphorus and two chlorine atoms in its structure. With $NF_3$ as the reactant gas CRIMS can provide simultaneous detection of P and Cl, thus seeming to be an ideal choice for the analysis of this drug and its metabolites. A plasma sample from a patient who received cyclophosphamide was analyzed for both phosphorus and chlorine content with CRIMS. While the H channel showed a complex chromatogram, only six peaks were seen in the P-selective channel, and five peaks appeared the Cl-selective channel. All but the first peak in the phosphorus channel were confirmed as cyclophosphamide-related by the response in the chlorine channel.

The first peak in the phosphorus channel was phosphate silylated with three t-butyldimethylsilyl (TBDMS) groups, as confirmed by its mass spectrum. A TBDMS derivatized cyclophosphamide standard solution showed three peaks, which matched the retention times of peaks 2, 3 and in the sample chromatogram. Peak 5 was found to be TBDMS-cyclophosphamide. Peak 3 was underivatized cyclophosphamide. Peak 2 showed an area ratio of the Cl to the P channel half the value of other two peaks, indicating there is a loss of one of the two chlorine atoms in cyclophosphamide. The mass spectrum of this peak suggested that one of the two chloroethyl arms was missing.

The experimental results indicate that even for a complicated, biologically-derived sample, CRIMS with $NF_3$ provides selective detection for compounds containing P and Cl. Such drugs fit into the definition of "intrinsically labeled" (12), and therefore can simplify metabolism studies since the special synthesis to incorporate "extrinsic" isotopic labels in the drug would be unnecessary.

$NF_3$ represents a new concept of reactant gases for CRIMS. By providing a fluorinating reaction environment, it permits the selective and simultaneous detection of phosphorus, and also deuterium, carbon, chlorine, and sulfur with the potential to include nitrogen and oxygen. The methods are sensitive, linear and reproducible. As the array of element and isotope selective detection capabilities of CRIMS grows, so should its applications.

Glutathione and Clozapine Study

The inventors conducted a study of covalent binding between the antipsychotic drug clozapine and the tripeptide glutathione. Other workers, primarily using radioisotopes, have found many adducts of clozapine and glutathione. The inventors queried how well the chlorine atom in clozapine could serve as an alternate to the use of a radiolabel using the Chemical Reaction Interface/Mass Spectrometer technique with HPLC introduction (HPLC/CRIMS). Incubations of the drug and glutathione with a peroxidase/peroxide system yielded several metabolites characterized as novel conjugates of clozapine by electrospray mass spectrometry. The identification of two conjugates was confirmed by examining the incubation mixture with $NF_3$ as the CRIMS reactant gas. The simultaneous appearance of both Cl and S is consistent with covalent binding of clozapine to glutathione. A nearly doubled ratio of S to Cl in one peak confirmed the presence of a di-glutathione conjugate. These experiments support applicants' proposition that element selective detection of HPLC effluent with CRIMS can supply additional information, not previously available using radioisotopic methods. One can see that both elemental species are present in the cluster of peaks eluting in the region between 10 and 15 minutes, showing that eh chlorine of clozapine and the sulfur of GSH are both present. Based on the electrospray data, the peak at 13.2 minutes is the mono-GSH adduct of hydroxyclozapine. If the areas under the S and Cl channels are calibrated to be 1:1 based on the structure, then the peak eluting just before it at 12.3 minutes has an S/Cl ratio of 1.83. This would be close to the 2.00 expected for the di-=GSH conjugate structure suggested by the ESI data. These experiments show that element-selective detection can be an important tool in carrying out drug metabolism studies. When the test species contains an element other than C, H, O, or N, such an element is a label that can serve as effectively as an isotopic label to trace the fate of the parent species. Even when the unknown drug or biochemical metabolit molecule contains none of these other species, chemical modifications that add an unusual element—sulfation, phosphorylation, and thioether linkages—can be detected. Such information will complement more traditional analytical approaches to identify metabolites. Here, applicants show the ability to carry out intramolecular elemental composition measurements. When applicants have previously measured C/Cl ratios with GC/CRIMS in experiments designed for that purpose, applicants have achieved precisions and accuracies better than 10% (Song and Abramson, 1993) and expect that coefficients of variation between 5 and 10% will be typical if sufficient replications are done.

REFERENCES (1) Markey, S. P.; Abramson, F. P. *Anal. Chem.* 1982, 54, 2375–2376.

(2) Chace, D. H.; Abramson, F. P. *Anal. Chem.* 1989, 61, 2724–2730.

(3) Morre, J. T.; Moini, M. *Biol. Mass Spectrom.* 1992, 21, 693–699.

(4) Chace, D. H.; Abramson, F. P. *Biomed. Environ. Mass Spectrom.* 1990, 19, 117–122.

(5) Chace, D. H.; Abramson, F. P. *J. Chromatogr.* 1990, 527, 1–10.

(6) Chace, D. H.; Abramson, F. P. In *Synthesis and Applications of Isotopically Labelled Compounds*, 1988; Baillie, T. A.; Jones, J. R., Eds.; Elsevier: Amsterdam, 1989; p. 253.

(7) Abramson, F. P. ; Markey, S. P. *Biomed. Environ. Mass Spectrom.* 1986, 13, 411–415.

(8) Moini, M.; Chace, D. H.; Abramson, F. P. *J. Am. Soc. Mass Spectrom.* 1991, 2, 250–255.

(9) Song, H.; Abramson, F. P. *Anal. Chem.* 1993, 65, 447–450.

(10) Kusmierz, J. J.; Abramson, F. P. *Biol. Mass Spectrom.* 1993, 22, 537–543.

(11) Teffera, Y.; Abramson, F. P.; McLean, M.; Vestal, M. *J. Chromatogr. Biomed. Appl.* 1993, 620, 89–96.

(12) Song, H.; Abramson, F. P. *Drug. Metab. Disp.* 1993, 21, 868–873.

(13) Li, G.; Moini, M., *Proc.* 42nd ASMS Conf. Mass Spectrom., 1994 p. 293.

(14) Teffera, Y.; Abramson, F. *Biol. Mass Spectrom.* 1994, 24, 776–783.

(15) O'Brien, M. J. in "*Modern Practice of Gas Chromatography*," Grob, R. L. Ed., 1985, p. 272.

(16) Quimby, B. D.; Sullivan, J. J., *Anal. Chem.* 1990, 62, 1027–1034.

(17) Song, H.; Kusmierz, J.; Abramson, F.; McLean, M. *J. Am. Soc. Mass Spectrom.* 1994, 8, 765–771

(18) Matsumoto, K., Fujiwara, K., and Fuwa, K. *Anal. Chem.* 1983, 55, 1665–1668

(19) Patterson, B. W.; Wolfe, R. R., *Biol. Mass Spectrom.* 1993, 22, 481–486.

(B1) Barrie, A., Bricout, J., and Koziet, J. Gas chromatography-stable isotope ratio analysis at natural abundance levels. *Biomed. Environ. Mass Spectrom.* 11: 583–588 (1984).

(M1) Markey, S. P. and Abramson, F. P., Capillary gas chromatography/mass spectrometry with a microwave discharge interface for determination of radioactive-carbon-containing compounds. *Anal. Chem.* 54: 2375–2376 (1982).

(M2) Markey, S. P. and Abramson, F. P., Element and isotope specific detection by capillary gas chromatography—mass spectrometry using a microwave discharge interface; in: W. P. Duncan and A. B. Susan (Eds.), Synthesis and Applications of Isotopically Labeled Compounds. *Proceedings of an International Symposium*, Kansas City, Mo., U.S.A., 1982, Elsevier, Amsterdam; 291–296, 1983.

(M3) Matthews, D. E., and Hayes, J. M., Isotope-ratio-monitoring gas chromatography—mass spectrometry. *Anal. Chem.* 50: 1465–1473 (1978).

(S1) Sano, M, Yotsui, Y., Abe, H., and Sasaki, S., A new technique for the detection of metabolites labelled by the isotope 13C using mass fragmentography. *Biomed. Mass Spectrom.* 3: 1–3 (1976).

The purpose of the above description and examples is to illustrate some embodiments of the present invention xwithout implying any limitation. It will be apparent to those of skill in the art that various modifications and variations may be made to the composition and method of the present invention without departing from the spirit or scope of the invention. All patents and publications cited herein are incorporated by reference in their entireties.

I claim:

1. A mass spectrometer apparatus for the sensitive detection of the isotope ratio of elements in a sample by a continuous in-line process that converts each element into a new chemical species in an environment comprising fluorine, comprising:

(a) a sample introduction component in which a mixture of analytes is separated into specific molecules, and wherein said sample introduction comprises means for continuous sample introduction into a chemical reaction interface;

(b) a chemical reaction interface (CRI) wherein said CRI converts intact analytes into new element-specific compounds in an environment comprising fluorine; and (c) a mass spectrometer capable of making precise isotopic measurements.

2. The apparatus of claim 1 wherein said sample introduction component is selected from the group consisting of a gas chromatograph and a high performance liquid chromatograph.

3. The apparatus of claim 1 wherein said chemical reaction interface is a microwave powered helium plasma interface.

4. The apparatus of claim 1 wherein said mass spectrometer is a multicollector isotope ratio mass spectrometer.

5. The apparatus of claim 2 wherein said sample introduction component is a high performance liquid chromatograph in which both nebulization and countercurrent flow is used to remove a liquid phase through a universal interface.

6. The apparatus of claim 2 wherein said sample introduction component is a high performance liquid chromatograph and a transport device is used to remove a liquid phase.

7. A method for measuring the mass of samples containing carbon, nitrogen, hydrogen, oxygen, chlorine, and sulfur compounds comprising:

(a) adding a sample containing carbon or nitrogen compounds to a sample introduction component in which a mixture of analytes is separated into specific molecules, and wherein said sample introduction comprises means for continuous sample introduction into a chemical reaction interface (CRI); wherein said CRI converts intact carbon and nitrogen analytes into new element-specific compounds in an environment comprising fluorine to resolve said compounds; and (b) calculating the isotope ratio of the compounds of said sample with mass spectrometer capable of making precise isotopic measurements.

8. The method of claim 7, wherein said mass spectrometer is selected from the group consisting of chemical reaction interface mass spectrometer (CRIMS) and an isotope ratio mass spectrometer system (IRMS).

9. The method of claim 7, wherein said fluorine reactant gas is NF3.

10. The method of claim 7, wherein said fluorine reactant gas is F2.

11. The method of claim 7, wherein said sample further comprises a compound selected from the group consisting of carbon, nitrogen, deuterium, chlorine, oxygen and sulfur.

12. The method of claim 11, wherein said sample comprises a compound containing carbon and nitrogen.

13. A method of evaluating the elemental and isotopic characteristics of unknown drugs or biochemical metabolites comprising the steps of (a) adding an unknown drug or biochemical metabolite sample containing to a sample introduction component in which a mixture of analytes is separated into specific molecules, and wherein said sample introduction comprises means for continuous sample introduction into a chemical reaction interface (CRI);. wherein said CRI converts intact carbon and nitrogen analytes into new element-specific compounds in an environment comprising fluorine to resolve said compounds; and (b) calculating the isotope ratio of the compounds of said sample with mass spectrometer capable of making precise isotopic measurements.

14. The method according to claim 13 wherein said unknown drug or biochemical metabolite sample comprises an element selected from the group consisting of carbon, nitrogen, deuterium, chlorine, oxygen and sulfur.

15. The method according to claim 13 wherein said method further comprises chemically modifying the unknown drug or biochemical metabolite sample by adding a sulfur, phosphorous or thioether linkage which can be detected by GC/CRIMS.

16. The method of claim 13 wherein said method is performed on the apparatus comprising:

(a) a sample introduction component in which a mixture of analytes is separated into specific molecules, and wherein said sample introduction comprises means for continuous sample introduction into a chemical reaction interface;

(b) a chemical reaction interface (CRI) wherein said CRI converts intact analytes into new element-specific compounds in an environment comprising fluorine; and (c) a mass spectrometer capable of making precise isotopic measurements.

* * * * *

UNITED STATES PATENT AND TRADEMARK OFFICE

CERTIFICATE OF CORRECTION

PATENT NO. : 6,031,228
DATED : February 29, 2000
INVENTOR(S) : F. Abramson

It is certified that error appears in the above-identified patent and that said Letters Patent is hereby corrected as shown below:

Column 1,
Line 9, please add the following:

-- STATEMENT AS TO FEDERALLY SPONSORED RESEARCH
Work described herein was supported by NSF grant BIR9216935 and NIH grant R01 GM036143. The U.S. Government has certain rights in the invention. --

Signed and Sealed this

Twenty-eighth Day of October, 2003

JAMES E. ROGAN
*Director of the United States Patent and Trademark Office*